US009157637B2

(12) United States Patent
Poyyapakkam et al.

(10) Patent No.: US 9,157,637 B2
(45) Date of Patent: Oct. 13, 2015

(54) BURNER ARRANGEMENT WITH DEFLECTION ELEMENTS FOR DEFLECTING COOLING AIR FLOW

(75) Inventors: Madhavan Poyyapakkam, Rotkreuz (CH); Adnan Eroglu, Untersiggenthal (CH); Andrea Ciani, Zurich (CH); Diane Lauffer, Wettingen (CH); Uwe Ruedel, Baden-Rütihof (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 993 days.

(21) Appl. No.: 13/219,185

(22) Filed: Aug. 26, 2011

(65) Prior Publication Data

US 2012/0047908 A1 Mar. 1, 2012

(30) Foreign Application Priority Data

Aug. 27, 2010 (CH) ..... 1388/10

(51) Int. Cl.
*F23R 3/00* (2006.01)
*F23R 3/34* (2006.01)
*F23R 3/04* (2006.01)

(52) U.S. Cl.
CPC ..... *F23R 3/346* (2013.01); *F23R 3/002* (2013.01); *F23R 3/04* (2013.01);
(Continued)

(58) Field of Classification Search
CPC ..... F23R 2900/03041; F23R 2900/03045; F23R 2900/03341; F23R 3/002; F23R 3/04; F23R 3/346; F23R 3/54; F23R 2900/03006; F23D 11/402; F02C 6/003
USPC ..... 60/753, 754, 755, 756, 774, 782, 785, 60/39.37, 39.17, 757, 760, 759, 758; 431/352
See application file for complete search history.

(56) References Cited

U.S. PATENT DOCUMENTS 3,589,128 A * 6/1971 Sweet ..... 60/757
5,381,652 A 1/1995 Mezzedimi et al.
(Continued)

FOREIGN PATENT DOCUMENTS

EP 0 919 190 A1 5/1999
EP 2 169 314 A2 3/2010
(Continued)

OTHER PUBLICATIONS

European Search Report issued on Mar. 9, 2011 for Application No. 01388/10 (with English language translation of category of cited documents).
(Continued)

*Primary Examiner* — Phutthiwat Wongwian
*Assistant Examiner* — Alain Chau
(74) *Attorney, Agent, or Firm* — Buchanan Ingersoll & Rooney PC

(57) ABSTRACT

An exemplary burner arrangement and method for operating a burner arrangement are disclosed. During operation of the burner arrangement a hot combustion gas, including combustion air, flows essentially parallel to a burner wall through a mixing chamber, which is delimited by the burner wall, to a combustion chamber. In the mixing chamber the hot combustion gas is mixed with an injected fuel, where cooling air from the outside of the burner wall flows through effusion holes in the burner wall into an interior of the mixing chamber. The cooling air, on the outside of the burner wall, is deflected in a directed manner in its flow direction by means of deflection elements which are in a distributed arrangement.

18 Claims, 4 Drawing Sheets

(52) U.S. Cl.
CPC ..... *F23R 2900/03041* (2013.01); *F23R 2900/03044* (2013.01); *F23R 2900/03045* (2013.01); *F23R 2900/03341* (2013.01)

(56) References Cited

U.S. PATENT DOCUMENTS

| | | | | |
|---|---|---|---|---|
| 5,435,139 | A * | 7/1995 | Pidcock et al. | 60/757 |
| 5,497,611 | A * | 3/1996 | Benz et al. | 60/776 |
| 6,019,596 | A * | 2/2000 | Knopfel et al. | 431/350 |
| 6,494,044 | B1 * | 12/2002 | Bland | 60/772 |
| 6,981,358 | B2 * | 1/2006 | Bellucci et al. | 60/39.17 |
| 8,312,722 | B2 | 11/2012 | York et al. | |
| 2005/0022531 | A1 * | 2/2005 | Burd | 60/752 |
| 2006/0059916 | A1 | 3/2006 | Cheung et al. | |
| 2007/0180827 | A1 * | 8/2007 | Dawson et al. | 60/752 |
| 2007/0227149 | A1 * | 10/2007 | Biebel et al. | 60/752 |
| 2008/0264065 | A1 * | 10/2008 | Gerendas | 60/754 |
| 2010/0000200 | A1 * | 1/2010 | Smith | 60/266 |
| 2010/0077720 | A1 * | 4/2010 | Poyyapakkam et al. | 60/39.53 |

FOREIGN PATENT DOCUMENTS

| | | | |
|---|---|---|---|
| JP | 58-072822 | A | 4/1983 |
| JP | 2010-101309 | A | 5/2010 |

OTHER PUBLICATIONS

"Field Experience With the Sequential Combustion System of the GT24/GT26 Gas Turbine Family", ABB Review 5, 1998, pp. 12-20.
European Search Report dated Jul. 1, 2013, issued by the European Patent Office in the corresponding European Application No. 11177535.9. (5 pages).
Notification of Reasons for Refusal issued Apr. 20, 2015 by the Japanese Patent Office in corresponding Japanese Patent Application No. 2011-183282, and an English translation thereof (11 pages).

* cited by examiner

BURNER ARRANGEMENT WITH DEFLECTION ELEMENTS FOR DEFLECTING COOLING AIR FLOW

RELATED APPLICATION

This application claims priority under 35 U.S.C. §119 to Swiss Patent Application No. 01388/10 filed in Switzerland on Aug. 27, 2010, the entire content of which is hereby incorporated by reference in its entirety.

FIELD

The present disclosure relates to burner technology, such as a method for operating a burner arrangement and a burner arrangement for implementing the method.

BACKGROUND INFORMATION

Gas turbines with sequential combustion have been known in the prior art, in which the combustion gases from a first combustor, after performing work in a first turbine, are fed to a second combustor, where, with the aid of the combustion air which is contained in the combustion gases, a second combustion takes place, and the reheated gases are fed to a second turbine.

For this second combustion, SEV burners such as those described for example in "Field experience with the sequential combustion system of the GT24/GT26 gas turbine family", ABB Review 5, 1998, p. 12-20, or in EP 2 169 314 A2 can be used.

FIG. 1 is a perspective view of an SEV burner, in accordance with the prior art. As shown in FIG. 1, the SEV burner 10 includes a mixing chamber 12 which extends in a flow direction (see the long arrows). Connected upstream to the mixing chamber 12 is an inlet 11, through which combustion gases 18 from the first combustor (not shown) can enter the mixing chamber 12 after expansion in the first turbine (not shown). Connected downstream to the mixing chamber 12 is a combustion chamber 13 in which a burner flame, with a corresponding flame boundary 17, is formed during operation. The mixing chamber 12 is outwardly delimited by means of a burner wall 15 which has a multiplicity of effusion holes 16. An angled fuel lance 14 projects into the mixing chamber 12, from which a fuel 19 is injected into said mixing chamber 12.

FIG. 2 shows a section view through the burner wall of an SEV burner with effusion cooling in accordance with the prior art. Cooling air 20 is fed on the outside opposite to the flow direction of the combustion gases 18 in the mixing chamber 12 and enters the mixing chamber 12 through the effusion holes 16 in the burner wall 15 and brings about effusion cooling (see FIG. 2). As a result of feeding the cooling air along the burner wall 15, this is convectively cooled. As disclosed in EP 2 169 314 A2, there is a desire in the case of such SEV burners to improve cooling and to prevent flashback so that the sequential burners can be operated at higher hot gas temperatures and with highly reactive fuels.

In the case of conventional burners of gas turbines as disclosed in, U.S. Pat. No. 7,493,767 B2; an impingement cooling of transition pieces, to vary and influence the distribution of cooling air over the impingement cooling plate using holes in the plate equipped with "flow capturing elements" or "scoops" to provide locally higher mass flows of cooling air. Since in this case, owing to the lack of effusion cooling, the cooling air does not enter the mixing chamber directly through the burner wall but is guided along the burner wall on the outside, no consideration has to be taken for the interaction of the flow in the mixing chamber with cooling air which flows in through the burner wall.

In the case of an SEV burner, however, there is a close relationship between the distribution of the inflowing diffusion cooling air and the flow conditions in the mixing chamber or in the subsequent combustion chamber.

SUMMARY

An exemplary method for operating a barrier arrangement is disclosed. The method comprising flowing a hot combustion gas, including combustion air, parallel to a burner wall through a mixing chamber, which is delimited by this burner wall, to a combustion chamber; mixing the hot combustion gas with an injected fuel in a mixing chamber; flowing cooling air from an outside of the burner wall through effusion holes in the burner wall into an interior of the mixing chamber, wherein the cooling air, on the outside of the burner wall, is deflected in its flow direction by means of deflection elements.

An exemplary burner arrangement is disclosed. The barrier arrangement comprising a mixing chamber which extends in a flow direction, wherein the mixing chamber is delimited on an outside surface by a burner wall, upstream has an inlet for a hot combustion gas which contains combustion air, and to which a combustion chamber is connected downstream, wherein the mixing chamber includes a fuel lance for injecting fuel, the fuel lance projecting into the mixing chamber, and wherein the burner wall is provided with effusion holes through which cooling air, which is introduced on the outside of the burner wall, can flow into the mixing chamber; and a plurality of deflection elements arranged on the outside of the burner wall to deflect the introduced cooling air towards said burner wall.

BRIEF DESCRIPTION OF THE DRAWINGS

The disclosure shall subsequently be explained in more detail based on exemplary embodiments in conjunction with the drawing. In the drawing

DETAILED DESCRIPTION

Figure 1:
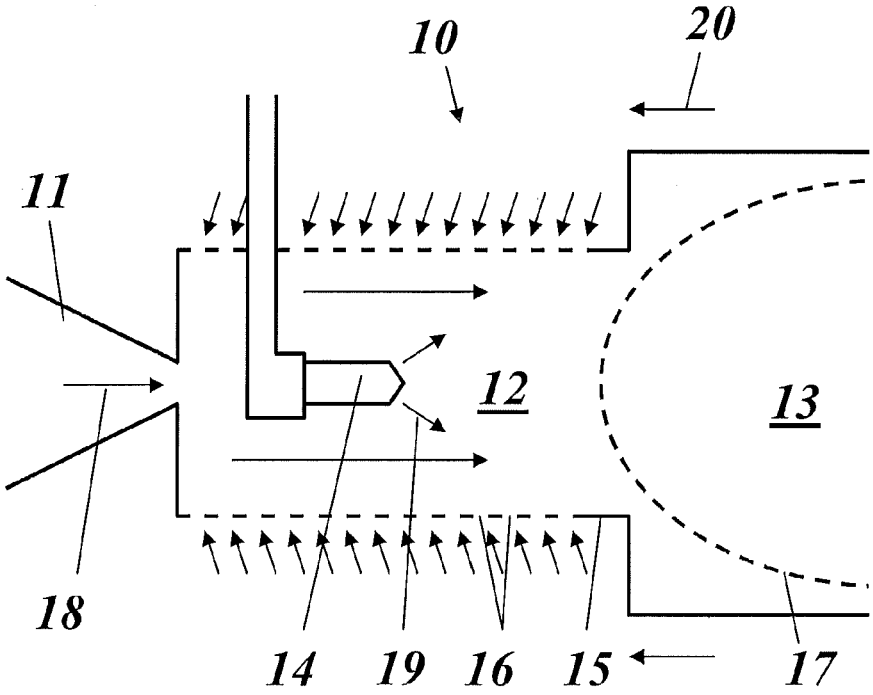
FIG. 1 is a perspective a view of an SEV burner, in accordance with the prior art.

Exemplary embodiments of the disclosure are directed to improving the method for operating a burner arrangement so that higher combustion temperatures can be achieved or highly reactive fuels can be used, and also to a burner arrangement for implementing the method.

In the exemplary embodiments cooling air is deflected in a directed manner on the outside of the burner wall in its flow direction by means of deflection elements which are in a distributed arrangement. As a result, the effusion cooling can be virtually "tailored" in order to intensify its effect in specified regions of the burner. The use of deflection elements enables a greatly improved adjustment of the direction of the injected effusion cooling air. As a result, the flow conditions inside the mixing chamber are optimized, which, when considering the stability of combustion of reactive fuels, benefits operational reliability.

The deflection elements allow a more intensely concentrated effusion cooling of the burner in their region. The deflection elements can be attached directly on the outer surface of the burner wall. They can have the form of a halved spherical half-shell and thereby resemble an orchestra shell. The height and width of the semicircle-like opening of the deflection elements can be varied as a function of the diameter and spacing of the effusion holes which are covered by it. The number and the positioning of the deflection elements depend upon the design of the burner. The orientation of the deflection elements (e.g., the alignment of their openings) can be selected so that the maximum cooling air flow is deflected into the effusion holes. The deflection elements can be produced and fastened either individually or produced together in the form of a correspondingly stamped and/or embossed plate. The deflection elements can be welded or cast on the burner wall. The number and diameter of the effusion holes can also be adapted to the positions of the deflection elements.

In an exemplary embodiment the cooling air on the outside of the burner wall has a velocity component which is parallel to the burner wall, and in that the cooling air is deflected towards the burner wall.

In another exemplary embodiment cooling air is deflected by means of one deflection element in each case into one of the effusion holes.

In yet another exemplary embodiment the cooling air is deflected by means of one deflection element in each case into a plurality of effusion holes.

In an exemplary embodiment the effusion holes are inclined by their axes to the burner wall, and in that the cooling air is deflected by means of the deflection elements such that upon entry into the effusion holes it flows essentially parallel to the axes of the effusion holes.

In another exemplary embodiment of a method of the present disclosure the effusion holes are inclined by their axes to the burner wall, and in that the cooling air is deflected by means of the deflection elements such that upon entry into the effusion holes the cooling air flows essentially perpendicularly to the burner wall.

In yet another exemplary embodiment of the method of the present disclosure a perforated plate with holes is arranged on the outside of the burner wall and at a distance from the burner wall, such that cooling air is introduced on the side of the perforated plate which faces away from the burner wall and by means of the deflection elements is deflected into the holes of the perforated plate and flows towards the burner wall.

In an exemplary embodiment of the method of the present disclosure spoon-like shells are used as deflection elements, which shield the associated effusion holes from one side and are open in the direction of the inflowing cooling air.

In another exemplary embodiment a burner arrangement includes a mixing chamber which extends in a flow direction. The mixing chamber is delimited on the outside by a burner wall and upstream has an inlet for a hot combustion gas which contains combustion air, and to which a combustion chamber is connected downstream, wherein a fuel lance for injecting a fuel projects into the mixing chamber and the burner wall is provided with effusion holes through which cooling air, which is introduced on the outside of the burner wall, can flow into the mixing chamber, wherein deflection elements are arranged on the outside of the burner wall and deflect the introduced cooling air towards said burner wall.

In another exemplary embodiment of the burner arrangement of the present disclosure the deflection elements are designed such that cooling air is deflected towards the burner wall.

In an exemplary embodiment of the burner arrangement of the present disclosure one deflection element can be associated in each case with one of the effusion holes.

In another exemplary embodiment of the burner arrangement of the present disclosure one deflection element is associated in each case with a plurality of effusion holes.

In yet another exemplary embodiment of the burner arrangement of the present disclosure the effusion holes are inclined by their axes to the burner wall, and the deflection elements are designed such that the cooling air, upon entry into the effusion holes, flows essentially parallel to the axes of the effusion holes.

In an exemplary embodiment of the burner arrangement of the present disclosure the effusion holes are inclined by their axes to the burner wall, and the deflection elements are designed such that the cooling air, upon entry into the effusion holes, flows essentially perpendicularly to the burner wall.

In another exemplary embodiment of the burner arrangement of the present disclosure a perforated plate with holes is arranged on the outside of the burner wall and at a distance from the burner wall, and the deflection elements are arranged on the side of the perforated plate which faces away from the burner wall such that cooling air is deflected by means of the deflection elements into the holes of the perforated plate and flows towards the burner wall.

In yet another exemplary embodiment of the burner arrangement of the present disclosure the deflection elements are designed as spoon-like shells which shield the associated effusion holes from one side and are open in the direction of the inflowing cooling air.

In yet another exemplary embodiment of the burner arrangement of the present disclosure the deflection elements are attached on the outer surface of the burner wall or of the perforated plate.

Exemplary embodiments of the present disclosure provide for "tailoring" or optimizing the effusion cooling of a known burner as shown in FIG. 1, to intensify its effect in the particularly critical regions of the burner (e.g., the particularly hot regions). This cooling is carried out by aerodynamically formed deflection elements arranged on the cold or outer side of the burner wall. The presence of these spoon-like deflection elements 21, which are formed in the style of a half spherical half-shell, enables the direction of the injected effusion cooling air to be adjusted according to the respective specifications.

Furthermore, the deflection elements 21, in regions in which the flow velocity of the cooling air on the outer side of the burner wall 15 and the static pressure, on account of the high flow velocity, are reduced, dam up the flow, and convert at least some of the dynamic pressure into static pressure. The deflection elements 21 therefore allow the feed pressure for the effusion cooling to be increased and to be adjusted.

Figure 3:
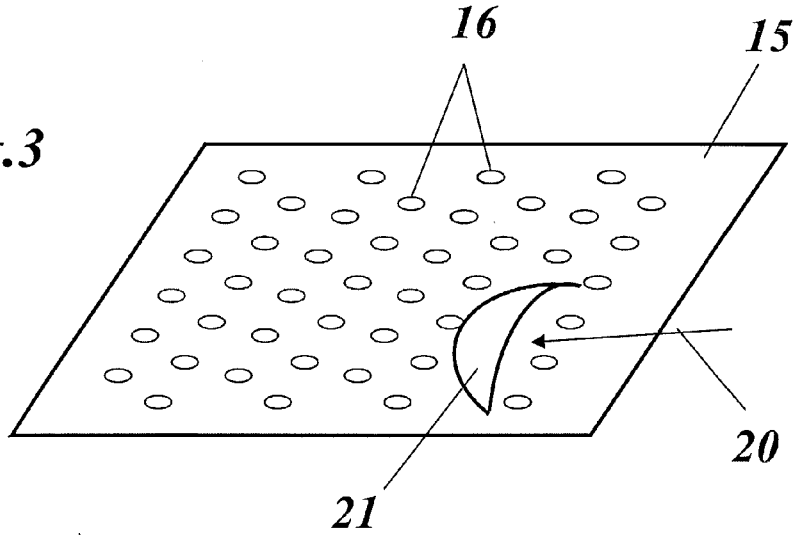
FIG. 3 shows a perspective view of a burner wall equipped with a deflection element which deflects the cooling air into a plurality of effusion holes at the same time in accordance with an exemplary embodiment of the present disclosure.

FIG. 3 shows a perspective view of a burner wall equipped with a deflection element which deflects the cooling air into a plurality of effusion holes at the same time in accordance with an exemplary embodiment of the present disclosure. In particular, FIG. 3 shows a small detail of the burner wall 15 with a multiplicity of effusion holes 16, which are in a distributed arrangement therein, through which cooling air flows into the mixing chamber 12. Furthermore, FIG. 3 shows an individual deflection element 21 which, being representative of further deflection elements which are not shown, covers a plurality of the effusion holes 16 so that the cooling air 20 which flows along the burner wall 15 in the direction of the arrow is captured and deflected towards the effusion holes 16. Many such deflection elements 21, with different density and orientation, can be arranged over the entire burner wall 15 in order to deflect the cooling air 20 in an optimum manner.

Figure 4:
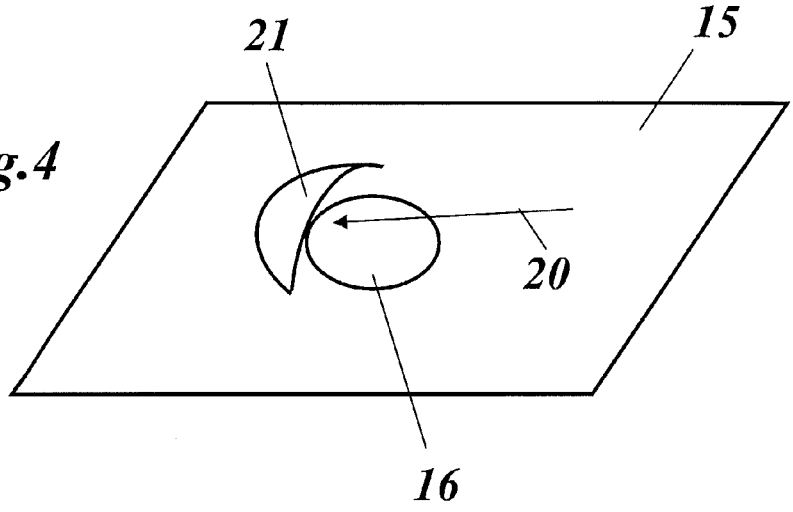
FIG. 4 shows a perspective view of a burner wall which is equipped with a deflection element which deflects the cooling air into only one effusion hole in accordance with an exemplary embodiment of the present disclosure.

The size of the deflection elements 21 in relation to the diameters of the effusion holes 16 can be varied. FIG. 4 shows a perspective view of a burner wall which is equipped with a deflection element which deflects the cooling air into only one effusion hole in accordance with an exemplary embodiment of the present disclosure. In particular, FIG. 4 shows an individual arrangement of a deflection element 21, which can be associated with only one individual effusion hole 16. As a result, the distribution of the deflected cooling air in the area can be even more finely sub-divided.

As a result of selecting the size of the deflection elements 21 in relation to the diameters of the effusion holes 16, the function can be established as a deflecting element or as a damming element for recuperation of the dynamic pressure.

Figure 2:
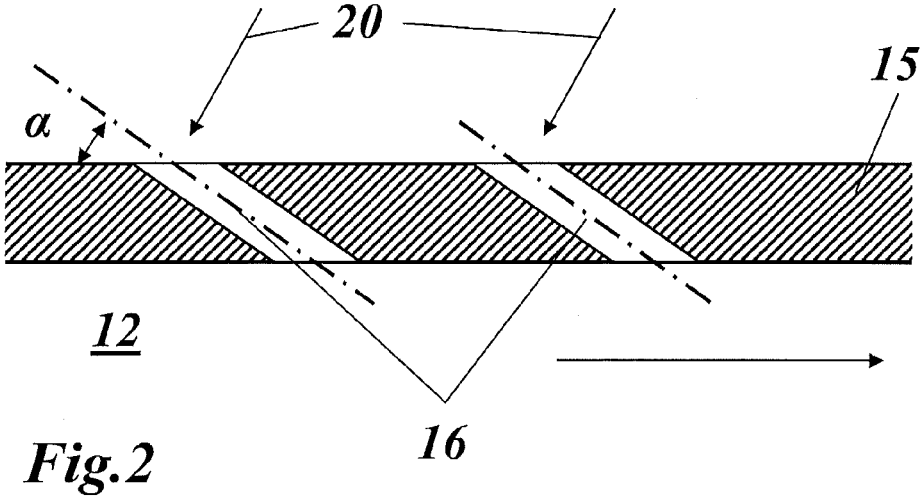
FIG. 2 shows a section view through the burner wall of an SEV burner with effusion cooling in accordance with the prior art.

In principle, the effusion holes 16 can be oriented with their hole axes perpendicular to the plane of the burner wall 10. In most cases, however, as shown in FIG. 2, the axes of the effusion holes 16 can be inclined to the plane of the burner wall 15 so that the cooling air which flows in through the effusion holes 16 has a velocity component which is parallel to the main flow in the mixing chamber 12, and the axial length and therefore the cooling effect are increased. The angle $\alpha$, which the axis includes with the wall plane, may lie, for example, within a range of between 10° and 80°, within a sub-range between 20° and 50°, and more preferably within a sub-range between 30° and 40°. An angle of 35°, for example, is an exemplary value suitable for achieving the desired cooling results to be a particularly suitable value.

Figure 5:
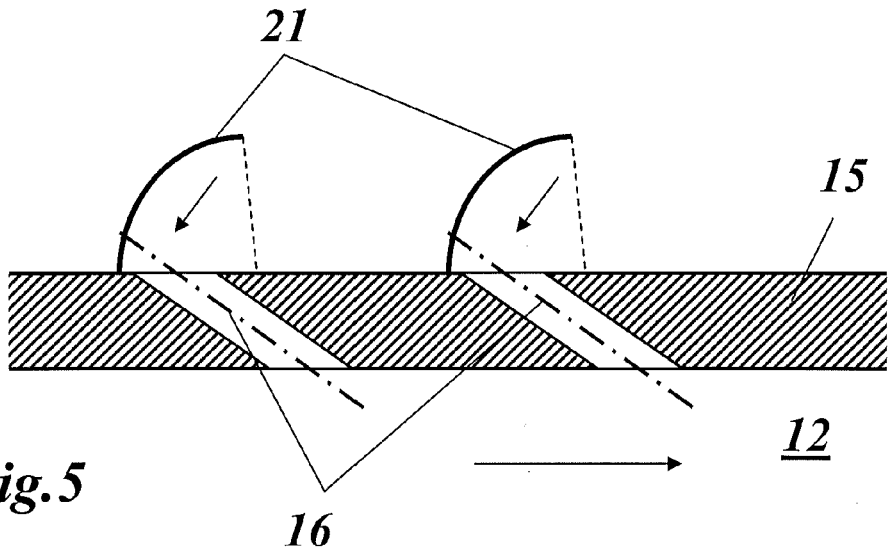
FIG. 5 shows a burner wall which is equipped with deflection elements of a first type in accordance with an exemplary embodiment of the present disclosure.

FIG. 5 shows a burner wall which is equipped with deflection elements of a first type in accordance with an exemplary embodiment of the present disclosure. With such inclined effusion holes 16, the deflection elements 21, as shown in FIG. 5, can be formed so that the deflected cooling air impinges largely perpendicularly upon the burner wall 15 and therefore upon the hole entrances.

Figure 6:
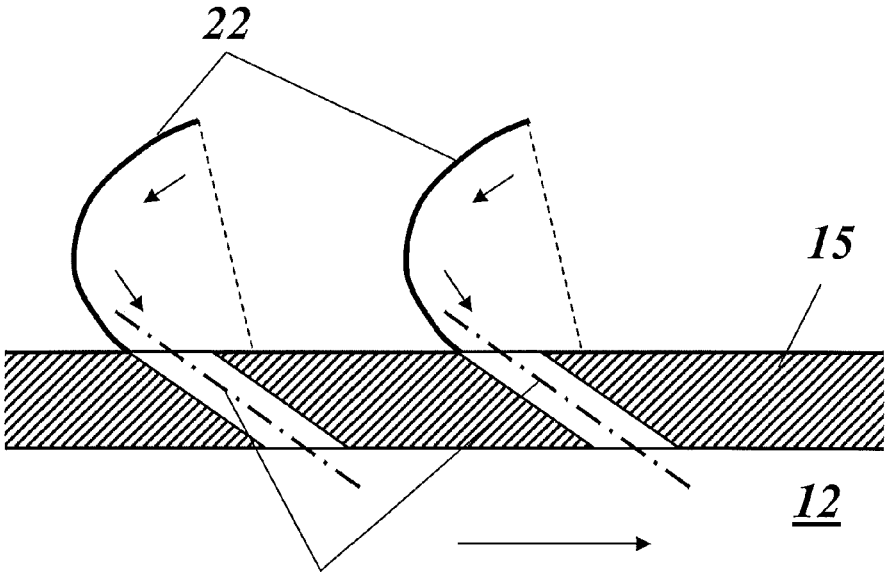
FIG. 6 shows a burner wall, which is equipped with deflection elements of a second type in accordance with an exemplary embodiment of the present disclosure.

FIG. 6 shows a burner wall, which is equipped with deflection elements of a second type in accordance with an exemplary embodiment of the present disclosure. It can be fluidically more favorable, however, according to FIG. 6, to set the curvature of the deflection elements 22 so that the deflected cooling air enters the effusion holes 16 practically in the direction of the hole axes.

Figure 7:
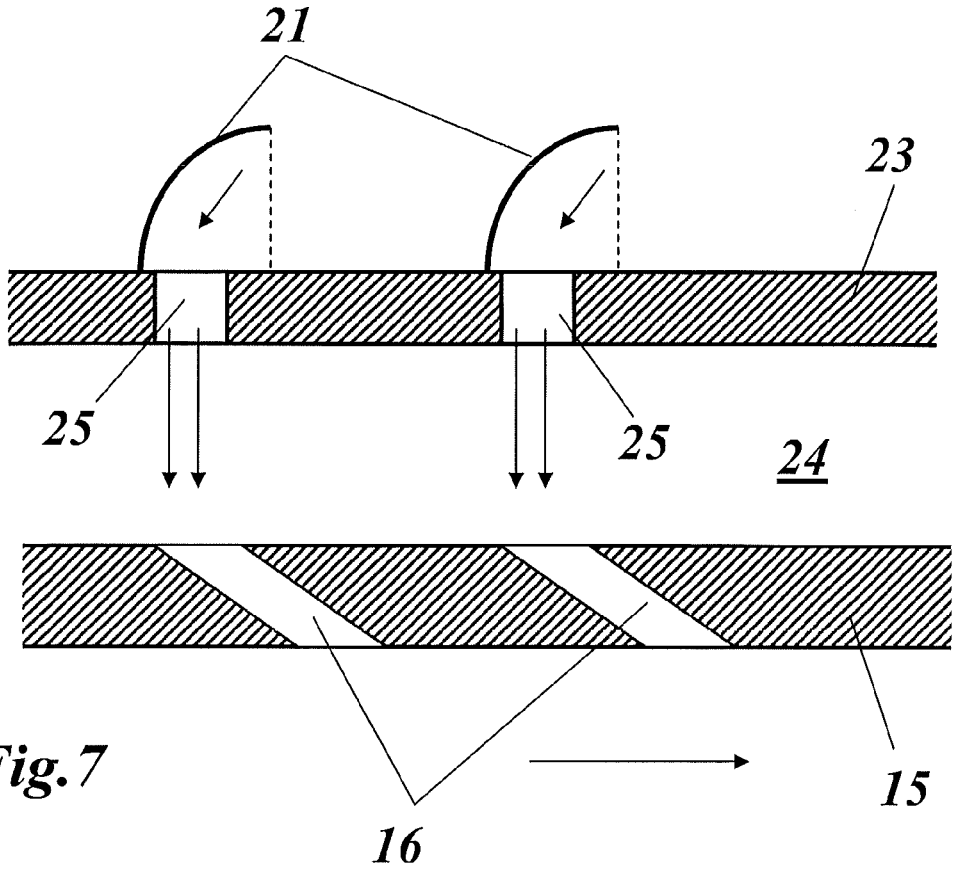
FIG. 7 shows a burner wall, which is enclosed, at a distance, by a perforated plate with deflection elements in accordance with an exemplary embodiment of the present disclosure.

FIG. 7 shows a burner wall, which is enclosed, at a distance, by a perforated plate with deflection elements in accordance with an exemplary embodiment of the present disclosure. As shown in FIG. 7, a perforated plate 23 can be arranged on the outside at a distance from the burner wall 15, the perforated plate being equipped with corresponding holes 25 into which cooling air is deflected by means of the deflection elements 21, which are arranged on the perforated plate 23, in order to then cross the intermediate space 24 between perforated plate 23 and burner wall 15 and to enter the effusion holes 16. As a result of this arrangement, on the one hand an additional impingement cooling effect on the burner wall 15 is achieved. On the other hand, the association of the deflected cooling air with the effusion holes is more indirect compared with the configuration from FIG. 5 and FIG. 6.

The described effusion cooling is not limited to the mixing chamber 12 but can also extend to the liner of the combustion chamber 13. In addition to the actual cooling, the effusion cooling in the liner can avoid self-ignition of the air-fuel mixture. In addition to the cooling, the effusion cooling in the mixing chamber 12 or premixer can avoid stagnation of the combustible gases on the burner wall 15 by forming a boundary layer.

The deflection elements 21, 22 can fulfill the following tasks:

- increasing the cooling air mass flow through the small holes (conversion of the dynamic pressure into static pressure);
- preventing a flashback; and
- functioning as a vortex generator (turbulator) on the cold side of the burner wall 15.

The function of forming a vortex of the cooling air by means of the deflection elements 21, 22 can be augmented by the deflection elements 21, 22 being attached in a specific overall arrangement (e.g., staggering) in order to fluidically mutually influence the function. As a result, the convective cooling on the outside of the burner wall 15 is increased. Rows of deflection elements 21, 22 can therefore be arranged at right angles to the flow direction of the cooling air 20, for example, wherein the deflection elements 21, 22 of two consecutive rows can be arranged in each case in an offset manner to each other.

The deflection elements 21, 22 can locally intensify the effusion cooling of the burner. If, according to FIG. 7, a perforated plate 23 is used as an impingement cooling plate with deflection elements, the heat transfer coefficient on the cold side of the burner wall 15 can be increased. The deflection elements 21, 22 can be arranged in the regions where the cooling air has a high velocity, in order to deflect more cooling air into the effusion holes 16.

Many regions of the effusion cooling are limited by the velocity of the cooling air being high and only in the presence of a low static pressure prevailing. Many regions of the effusion cooling must be intensified because the thermal load on the hot gas side (e.g., on account of a high heat transfer coefficient or a high flame temperature) is particularly high. The deflection elements have a combination of damming up and deflection, to capture cooling air which would otherwise flow past the effusion holes. In this manner, the cooling can be locally intensified without the risk of crack development being increased as a result of an increase of the number of effusion holes or increase of the diameter of the effusion holes.

The deflection elements altogether have the following characteristics:

- the shape is that of a half spherical half-shell, wherein height and width can be varied as a function of diameter and spacing of the effusion holes;
- the number and positioning of the deflection elements depends upon the form of the burner;
- the alignment of the deflection elements can be selected so that a maximum cooling air flow is introduced into the effusion holes;
- deflection elements cover either an individual effusion hole or a plurality of effusion holes at the same time;
- the deflection elements can be produced and attached either individually or at the same time in the form of an embossed and/or stamped plate;

the deflection elements can be welded or cast on the burner; and the number and the diameter of the effusion holes can be varied in dependence upon the positioning of the deflection elements.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

10 SEV burner (burner arrangement)
11 Inlet
12 Mixing chamber
13 Combustion chamber
14 Fuel lance
15 Burner wall
16 Effusion hole
17 Flame boundary
18 Combustion gas
19 Fuel
20 Cooling air
21, 22 Deflection element
23 Perforated plate
24 Intermediate space
25 Hole
α Angle

What is claimed is:

1. A method for operating a burner arrangement, comprising:

flowing a hot combustion gas, including combustion air, parallel to a burner wall through a mixing chamber, which is delimited by the burner wall, to a combustion chamber;

mixing the hot combustion gas with an injected fuel in the mixing chamber;

feeding a cooling air along the burner wall; and arranging a perforated plate with holes on the outside of the burner wall and at a distance from said burner wall, and introducing the cooling air on a side of the perforated plate which faces away from the burner wall, and deflecting the cooling air with deflection elements into the holes of the perforated plate and towards the burner wall, wherein each of the deflection elements are arranged on the outside of the perforated plate over an inlet of at least one of the holes of the perforated plate; and flowing the cooling air from outside of the burner wall through effusion holes in the burner wall into an interior of the mixing chamber, and wherein the effusion holes extend through the burner wall from a side facing the perforated plate to a side of the wall facing the hot combustion gases.

2. The method as claimed in claim 1, wherein the cooling air, on the outside of the burner wall, has a velocity component which is parallel to the burner wall, and the cooling air is deflected towards the burner wall.

3. The method as claimed in claim 2, wherein the deflection elements each cover an individual effusion hole; and deflecting cooling air into each of the individual effusion holes.

4. The method as claimed in claim 3, wherein the effusion holes are inclined by their axes to the burner wall; and deflecting the cooling air by the deflection elements such that upon entry into the effusion holes, the cooling air flows parallel to the axes of the effusion holes.

5. The method as claimed in claim 3, wherein the effusion holes are inclined by their axes to the burner wall; and deflecting the cooling air by the deflection elements such that upon entry into the effusion holes the cooling air flows essentially perpendicularly to the burner wall.

6. The method as claimed in claim 2, wherein the deflection elements each cover a plurality of effusion holes; and deflecting cooling air into the plurality of effusion holes.

7. The method as claimed in claim 1, wherein the cooling air, on the outside of the burner wall, has a velocity component which is parallel to the burner wall, and the static pressure of the cooling air upstream of the deflection element is increased.

8. The method as claimed in claim 1, wherein the deflection elements are half spherical half-shells, which shield the associated effusion holes from one side and are open in the direction of the inflowing cooling air.

9. The method as claimed in claim 1, comprising:

feeding the cooling air opposite to the flow direction of the combustion gases.

10. The method as claimed in claim 1, wherein an inside of the burner wall and an outside of the burner wall are parallel to each other.

11. A burner arrangement, comprising:

a mixing chamber which extends in a flow direction, wherein the mixing chamber is delimited on an outside surface by a burner wall, upstream has an inlet for a hot combustion gas which contains combustion air, and to which a combustion chamber is connected downstream, wherein the mixing chamber includes a fuel lance for injecting fuel, the fuel lance projecting into the mixing chamber, and wherein the burner wall is provided with effusion holes through which cooling air, which is fed along the burner wall and introduced on the outside of the burner wall, and flows into the mixing chamber; and a perforated plate with holes arranged on the outside of the burner wall and at a distance from said burner wall, and wherein a plurality of deflection elements are arranged on a side of the perforated plate which faces away from the burner wall such that cooling air is deflected by a plurality of deflection elements, each of the plurality of deflection elements arranged over an inlet of at least one of the holes of the perforated plate to deflect the introduced cooling air towards said burner wall and into each of the effusion holes, and wherein the effusion holes extend through the burner wall from a side facing the perforated plate to a side of the wall facing the hot combustions gases.

12. The burner arrangement as claimed in claim 11, wherein the plurality of deflection elements are designed such that the cooling air is deflected towards the burner wall.

13. The burner arrangement as claimed in claim 11, wherein each of the plurality of deflection elements is associated with one of the effusion holes.

14. The burner arrangement as claimed in claim 13, wherein the effusion holes are inclined by their axes to the burner wall, and the deflection elements allow the cooling air, upon entry into the effusion holes, to flow essentially parallel to the axes of said effusion holes.

15. The burner arrangement as claimed in claim 13, wherein the effusion holes are inclined by their axes to the burner wall, and the deflection elements allow the cooling air, upon entry into the effusion holes, to flow essentially perpendicularly to the burner wall.

16. The burner arrangement as claimed in claim 11, wherein each of the plurality of deflection elements is associated with a plurality of effusion holes.

17. The burner arrangement as claimed in claim 11, wherein the deflection elements are half spherical half-shells, which shield the associated effusion holes from one side and are open in the direction of the inflowing cooling air.

18. The burner arrangement as claimed in claim 11, wherein an inside of the burner wall and an outside of the burner wall are parallel to each other.

* * * * *